US006251240B1

(12) United States Patent
Kum et al.

(10) Patent No.: US 6,251,240 B1
(45) Date of Patent: Jun. 26, 2001

(54) MG-CA SACRIFICIAL ANODE

(75) Inventors: Dong Hwa Kum; Hye Sung Kim; Hyeon Joon Shin, all of Seoul; Jung Gu Kim, Kyungki-Do; Ji Young Byun, Seoul, all of (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 09/482,525

(22) Filed: Jan. 14, 2000

(30) Foreign Application Priority Data

Jan. 15, 1999 (KR) ..... 99-1044

(51) Int. Cl.[7] ..... C25B 11/04
(52) U.S. Cl. ..... 204/293
(58) Field of Search ..... 204/293, 292, 204/196.24; 205/733

(56) References Cited

U.S. PATENT DOCUMENTS 4,156,055 * 5/1979 Zellhoefer ..... 429/112
4,631,172 * 12/1986 Yamamoto et al. ..... 204/293
5,423,969 * 6/1995 Masumoto et al. ..... 204/293

OTHER PUBLICATIONS

ASTM Designation: B 843–93, "Standard Specification for Magnesium Alloy Anodes for Cathodic Protection," (2 pages) No month/year available.

Japanese Unexamined (Laid–Open) Patent Publication No. 50–25452, pp. 323–325 No month/year available.

J.A. Juarez–Islas, et al., "Improving the Efficiency of Magnesium Sacrificial Anodes," Journal of Metal (Sep. 1993), pp. 42–44.

M. Sakamoto, et al., "Suppression of Ignition and Burning of Molten Mg Alloys by Ca Bearing Stable Oxide Film," Journal of Materials Science Letters (1977), 16:1048–1050 No month available.

P&GJ Staff, "Magnesium Anode Utilization," Pipeline & Gas Journal (Feb. 1988), pp. 23–26.

H. A. Robinson, "Magnesium As A Galvanic Anode," A paper presented at the Ninetieth General Meeting held at Toronto, Canada, Oct. 19, 1946, pp. 485–508.

* cited by examiner

*Primary Examiner*—Bruce F. Bell
(74) *Attorney, Agent, or Firm*—Morrison & Foerster LLP

(57) ABSTRACT

A Mg—Ca sacrificial anode according to the present invention is disclosed, which is capable of providing a melts protection effect during a dissolution of Mg by adding Ca, which is a low melting point modification element, to Mg and obtaining characteristics which are equal to or better than a conventional Mg alloy group sacrificial anode in view of an open circuit potential and an anode efficiency.

2 Claims, 2 Drawing Sheets

MG-CA SACRIFICIAL ANODE

BACKGROUND OF THE INVENTION

1. Field of the Invention

The present invention relates to a Mg—Ca sacrificial anode, and in particular to a Mg—Ca sacrificial anode which is capable of restricting fire which frequently occurs during a melting of Mg, and for providing characteristics equal to or better than the conventional Mg alloy sacrificial anode in a driving potential and efficiency.

2. Description of the Background Art

A Mg-group sacrificial anode is connected to a steel structure (pipe, tank, etc.), which is buried underground, by an electric cable and is used to prevent corrosion of the steel structure. This is known as an internal power supply type (or sacrificial anode type) corrosion resisting technique (Contrary thereto, there is an external power supply type which supplies DC power).

The sacrificial anode represents a metal which is sacrificially corroded to prevent any corrosion of the surrounding metals. For example, there is a zinc coated steel in which zinc is coated on a steel. When the zinc coated steel is exposed under a corrosion environment, a galvanic cell is formed so that the zinc is priorly corroded and becomes an anode, and the steel becomes a cathode for thereby preventing corrosion.

In the cathodic protection method which is used for ship and marine structure, Al or Zn alloy is used as a sacrificial anode. The Mg-based sacrificial anode is generally used for a steel structure buried in soils which have a high resistivity. Since Mg has Inherent negative potential and high electrochemical equivalents, Mg is one of the most effective and economical metals for underground sacrificial anodes.

In order to effectively use the sacrificial anode to prevent any corrosion of a steel structure which is buried underground, a driving potential and anode efficiency of the sacrificial anode should be high for the reason that it is possible to prevent corrosion of steel by supplying sufficiently high protection current to the steel structure compared to an IR drop. The anode efficiency represents a ratio of total current amount which is produced by unit mass of an anode as a result of anodic dissolution, with respect to the theoretical current amount which can be calculated by Faraday's Law, and it is directly related to the life span of the sacrificial anode.

Before and after the world war II, Dow Chemical Company developed a sacrificial anode formed of a highly pure Mg, an AZ63 alloy having an excellent anode efficiency, and a Mg—Mn alloy having a high driving potential. In many countries, the Mg-group sacrificial anode is standardized with respect to the above-described various alloys. As seen in the Table 1, although a pure Mg sacrificial anode has a low open circuit potential value of −1.62~−1.67V based on a saturated copper/copper sulfute reference electrode and an anode efficiency characteristic of 40 to 50%, the above-described characteristic is observed only in the case of high purity of above 99.95% (The electrochemical potential (V) value hereinafter is a value determined based on a reference of the saturated copper/copper sulfate electrode). Therefore, in order to limit the impurities, a Mg—Mn alloy having a small amount of Mn was disclosed. This alloy is generally used under an environment in which the resistivity is high, the open-circuit potential is −1.75V, and the anode efficiency is 50%. The AZ63 alloy is manufactured by significantly enhancing the electrochemical characteristic by adding an alloy element such as Al, Zn, etc, by a fixed ratio and is generally used under an environment in which the resistivity is low, the open-circuit potential is −1.55V, and the efficiency is 60%. As another example, a study shows that the efficiency characteristic is more than 20% by heat-treating Mg—Mn alloy or AZ63 alloy or adding a low melting point element such as Be, etc.

Generally, a small amount of Mn is contained in the Mg-based sacrificial anode because Mn is an excellent scavenger element in Mg-alloy for control of the effects of impurities. Mn is added using a metal Mn or $MnCl_2$ when manufacturing the Mg—Mn alloy or the AZ63 alloy. In the case of using a metal Mn, since the melting point of the metal Mn is 1244° C., a dissolution temperature is increased for expediting a dissolution of the metal Mn into the Mg-alloy and the metal should be also finely ground in order to increase the producing yield of the Mn so that the fabrication process is complicated. In the case of using $MnCl_2$, and since $MnCl_2$ exists where the $MnCl_2$ includes four waters of crystallization at room temperature, a thermal dissolution process should be performed in order to eliminate the waters of crystallization at a certain temperature of above 195° C. In addition, if the Mg alloy which is used as a conventional sacrificial anode is exposed to atmosphere during a casting of the Mg, fire may occur thereby generating a large amount of sludge and a certain bad smell resulting in a large loss of source materials and degrading the working environment.

SUMMARY OF THE INVENTION

Accordingly, it is an object of the present invention to provide a Mg—Ca sacrificial anode which is capable of preventing fire by restricting a firing temperature of a furnace by adding a small amount of Ca during a dissolution of Mg and obtaining a better electrochemical characteristic compared to the conventional Mg group sacrificial anode.

To achieve the above object, there is provided a Mg—Ca sacrificial anode manufactured by adding Ca by not more than 0.6% as a low melting point modification process element in a Mg sacrificial anode.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention discloses a Mg—Ca sacrificial anode which is manufactured by adding Ca into Mg by not more than 0.6%. In the present invention, it is possible to restrict a firing characteristic of a Mg-alloy which is a problem of the conventional art when manufacturing the Mg-alloy by adding a small amount of Ca into Mg and to provide a Mg group sacrificial anode having an electrochemical characteristic of an anode efficiency higher than 60%.

In the Mg—Ca alloy, the grain is refined by adding Ca. Since an anode dissolution occurs uniformly based on the fine grain, the loss of anode due to a local corrosion is decreased, and an anode efficiency is increased. In addition, since an equivalent potential of Ca is lower than that of Mg, the open circuit potential is lowered by adding Ca. However, when the amount of Ca exceeds 0.6%, a large amount of $Mg_2Ca$ is formed at the grain boundaries for thereby decreasing the anode efficiency (refer to FIG. 2). The potential of $Mg_2Ca$ phase is more noble than that of Mg(Ca), which forms a galvanic cell. This means that $Mg_2Ca$ acts as a cathode, Mg(Ca) as an anode. The amount of $Mg_2Ca$ increases with increasing Ca content. Thus, the increased ratio of cathode-to anode area increases the galvanic corrosion near the junction along the grain boundary.

In addition, the liquidus line temperature of the Mg—Ca alloy is lowered than the melting point (615° C.) of a pure Mg. The structure of the oxide film which exists on the surface of the melts is refined compared to the case that there is no Ca. Therefore, a protection effect of the surface of the melts is enhanced, and it is possible to prevent frequent fire which occurs during the melting of a Mg alloy. In addition, it is possible to decrease the use of $SF_6$ or Ar gas which is used as a protection gas based on melts surface protection effect for thereby additionally obtaining a pollution prevention effect and cost reduction effect.

In the present invention, a small amount of Ca which has a low melting point modification element is added into Mg, so that it is possible to secure the stability of the melts. The open-circuit potential characteristic and anode efficiency characteristic are excellent. Therefore, there is a big difference compared to the conventional Mg—group sacrificial anode. In particular, it is possible to obtain a high driving potential which is equal to or higher than that of the conventional Mg—Mn alloy or an AZ63 alloy which are standardized to the sacrificial anodes.

The examples of the present invention will be explained in more detail.

EXAMPLE

Figure 3:
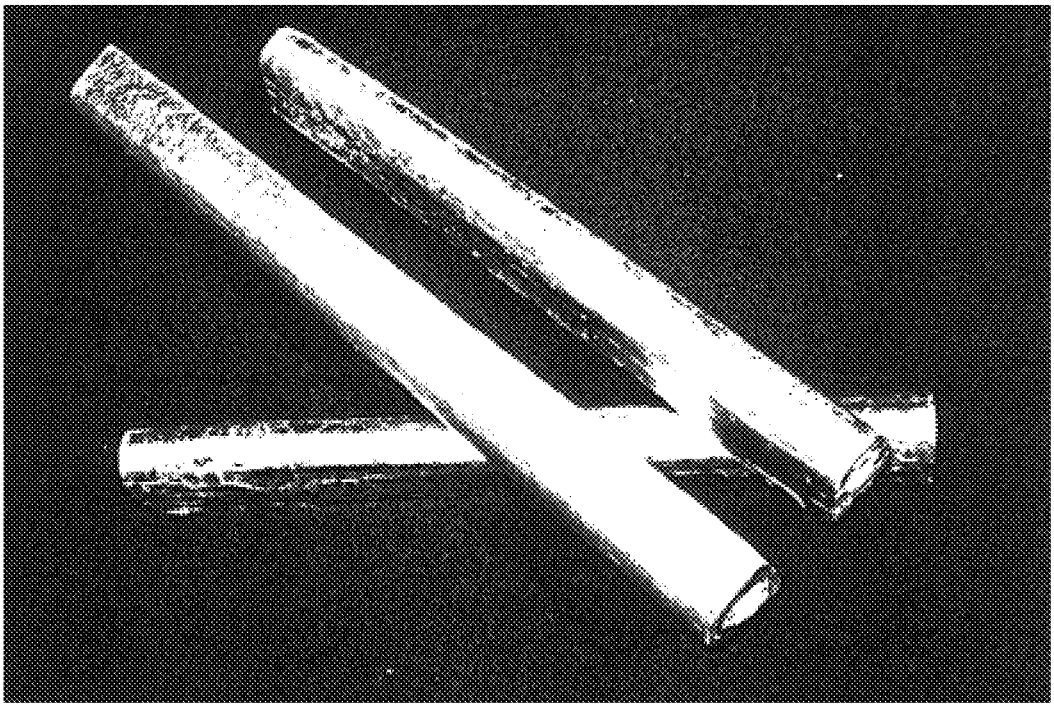
FIG. 3 is a picture of a Mg—Ca sacrificial anode according to the present invention.

Twenty kg of Mg is melted in an electric heating type dissolution furnace of which the temperature of 670° C. was maintained, and a mixed gas of 0.05% $SF_6$+dry air+$CO_2$ was blown thereinto and at the same time Ca was added thereto. The resultant material was stirred for 1~2 minutes using a stirring apparatus for uniformly mixing the Ca alloy element and was let to stand for 10 minutes for thereby manufacturing a Mg—Ca sacrificial anode shown in the picture of FIG. 3. The chemical composition and electrochemical characteristic of the thusly manufactured Mg—Ca alloy was compared with the pure Mg, Mg—Mn alloy and AZ63 alloy which are used as the Mg group sacrificial anode in the conventional art, and the result of the comparison is shown in the Table 1.

As shown in the Table 1, the Mg—Ca alloy has a high driving potential characteristic which is equal to or better than a high pure Mg alloy or the Mg—Mn alloy. In addition, it is known that it is possible to obtain a high efficiency characteristic which is equal to or better than that of the AZ63 alloy. Here, backfill is used around anodes installed in the underground to reduced contact resistance and local corrosion of the anode surface. It may also increase anode life. The typical backfill for Mg anode is composed of 75% Gypsum+20% Bentonite+5% sodium sulfate.

Figure 1:
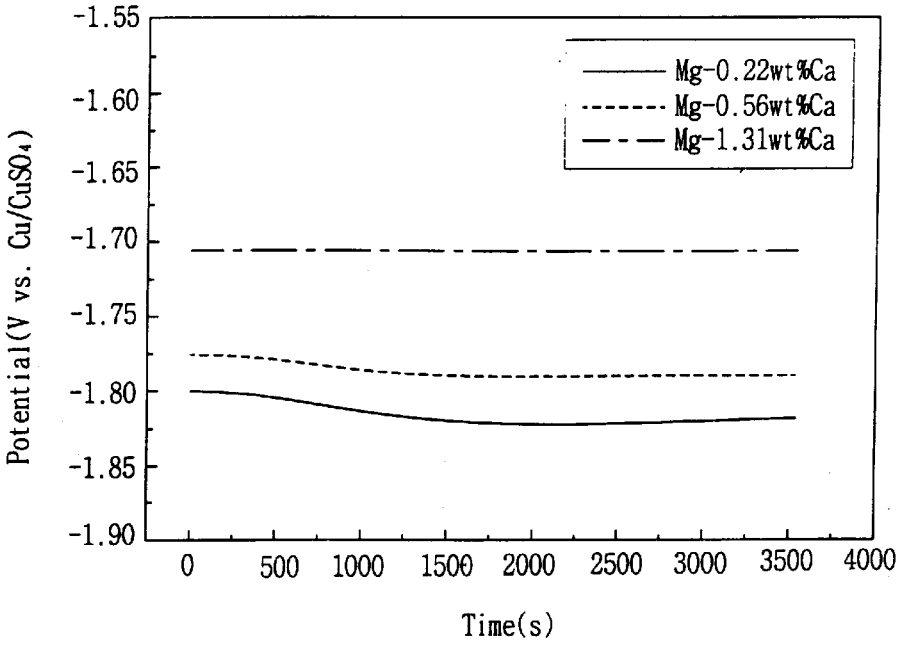
FIG. 1 is a graph of an open-circuit potential characteristic after 14-days galvaniostatic test.

FIG. 1 illustrates a graph of the result obtained by measuring an open circuit potential characteristic variation of a Mg—Ca sacrificial anode based on time with respect to the amount of Ca after 14 days galvanostatic test. As shown therein, the open-circuit potential of all Mg—Ca alloy is below −1.7V and is similar to the conventional pure Mg or Mg—Mn sacrificial anode. In particular, the Mg—Ca alloy containing Ca of 0.2~0.6% has an open circuit potential of −1.78~−1.8V which is lower than the Mg—Mn alloy having an open circuit potential of −1.75V.

Figure 2:
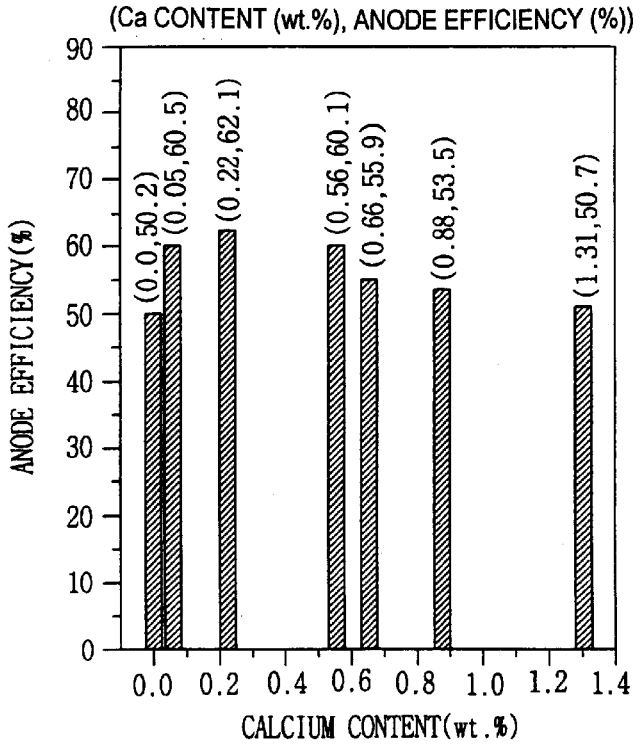
FIG. 2 is a graph of an anode efficiency characteristic based on the amount of Ca at a Mg—Ca sacrificial anode according to the present invention.

FIG. 2 is a graph of a comparison of an efficiency characteristic of the Mg—Ca sacrificial anodes based on the amount of Ca. As shown therein, all Mg—Ca alloy which contains Ca below 1.31 % exceeds 50%. In particular, the current efficiency of the Mg—Ca alloy which contains Ca not more than 0.6% exceeds 60%. Therefore, Mg—Ca alloy according to the present invention is similar to the AZ63 alloy which is known as a high efficiency alloy.

As described above, the Mg—Ca sacrificial anode according to the present invention has a high-driving potential and a high-efficiency characteristic, the Mg—Ca sacrificial anode may be used for various electrochemical environmental soil. Since it is possible to secure a stability of melts when manufacturing the Mg sacrificial anode based on the protection effect of the melts surface of Ca which is a low melting point modification element, it is possible to obtain a reducing effect of source materials and improve the limits of the cast work for thereby simplifying the fabrication process of the sacrificial anode, preventing pollution problems and decreasing the manufacturing cost.

Although the preferred embodiment of the present invention have been disclosed for illustrative purposes, those skilled in the art will appreciate that various modifications, additions and substitutions are possible, without departing from the scope and spirit of the invention as recited in the accompanying claims.

TABLE 1

Comparison of electrochemical characteristic between a conventional Mg-based sacrificial anodes and present Mg-Ca sacrificial anode

| | Type | | | |
|---|---|---|---|---|
| Content | High Purity Mg-anode (Galvoline) | AZ63 Alloy | Mg-Mn Alloy (Galvomag) | Present Mg-Ca Alloy |
| Al | ≦0.01 | 5.3–6.7 | ≦0.01 | ≦0.01 |
| Zn | ≦0.03 | 2.5–3.5 | — | ≦0.01 |
| Mn | ≦0.01 | ≧0.15 | 0.5–1.3 | ≦0.003 |
| Fe | ≦0.003 | ≦0.003 | ≦0.03 | ≦0.003 |
| Ni | ≦0.001 | ≦0.003 | ≦0.001 | ≦0.001 |
| Cu | ≦0.001 | ≦0.05 | ≦0.02 | ≦0.003 |
| Si | ≦0.01 | ≦0.3 | — | ≦0.02 |
| Mg | ≧99.95 | Remainder | Remainder | Remainder |
| Ca | — | — | — | ≦0.6 |
| Others | — | ≦0.03 | ≦0.05 respectively ≦0.3 max. | |
| Open-Circuit Potential (V) | −1.5 | −1.55 | −1.75 | −1.78–1.81 |

TABLE 1-continued

Comparison of electrochemical characteristic between a conventional Mg-based sacrificial anodes and present Mg-Ca sacrificial anode

| Content | Type | | | |
|---|---|---|---|---|
| | High Purity Mg-anode (Galvoline) | AZ63 Alloy | Mg-Mn Alloy (Galvomag) | Present Mg-Ca Alloy |
| Reference Electrode | $Cu/CuSO_4$ | $Cu/CuSO_4$ | $Cu/CuSO_4$ | $Cu/CuSO_4$ |
| Environment | Backfill | Backfill | Backfill | Backfill |
| Effective Current Capacity (Ah/g) | 1.1–1.21 | — | 1.21 | ≧1.32 |

TABLE 1-continued

Comparison of electrochemical characteristic between a conventional Mg-based sacrificial anodes and present Mg-Ca sacrificial anode

| Content | Type | | | |
|---|---|---|---|---|
| | High Purity Mg-anode (Galvoline) | AZ63 Alloy | Mg-Mn Alloy (Galvomag) | Present Mg-Ca Alloy |
| Efficiency (%) | About 60 | About 55–60 | About 50 | ≧60 |
| Type | Casting | Casting | Casting | Casting |

* The present Mg-Ca sacrificial anode was evaluated based on the ASTM G97 standard.

What is claimed is:

1. A Mg—Ca sacrificial anode, wherein a contents of Ca is no more than 0.6% by weight.

2. The Mg—Ca sacrificial anode of claim 1, wherein the Ca content is 0.2–0.6% by weight.

* * * * *